US005471694A

United States Patent [19]

Meheen

[11] Patent Number: 5,471,694

[45] Date of Patent: Dec. 5, 1995

[54] PREFABRICATED BRIDGE WITH PRESTRESSED ELEMENTS

[76] Inventor: H. Joe Meheen, 1562 S. Parker Rd. #228, Denver, Colo. 80231

[21] Appl. No.: 127,648

[22] Filed: Sep. 28, 1993

[51] Int. Cl.[6] ..... E04B 1/16; E04C 3/293

[52] U.S. Cl. ..... 14/73; 14/74.5

[58] Field of Search ..... 14/73, 74.5, 77.1; 52/174, 223.8, 745.2; 264/34, 35, 228, 33; 425/63

[56] References Cited

U.S. PATENT DOCUMENTS

| | | | |
|---|---|---|---|
| 3,604,167 | 9/1971 | Hays | 52/282 |
| 3,835,607 | 9/1974 | Raaber | 52/223.8 |
| 4,041,669 | 8/1977 | Rauenhorst | 52/576 |
| 4,123,485 | 10/1978 | Tang | 14/73 X |
| 4,493,177 | 1/1985 | Grossman | 52/745 |
| 4,894,967 | 1/1990 | Morton | 52/334 |
| 5,144,710 | 9/1992 | Grossman | 14/73 |

FOREIGN PATENT DOCUMENTS

| | | | |
|---|---|---|---|
| 940124 | 10/1963 | United Kingdom | 52/223.8 |

*Primary Examiner*—Ramon S. Britts
*Assistant Examiner*—James A. Lisehora
*Attorney, Agent, or Firm*—Richard W. Hanes

[57] ABSTRACT

A prefabricated bridge beam with prestressed elements comprising a rectangular girder-box assembly which includes a bottom plate prestressed in compression and a pair of upstanding side members each having their upper portions prestressed in tension and a poured and cured bridge deck supported by the said side members where the cured deck secures in place the said tension and compression stresses. The bridge beam is constructed by supporting the girder-box centrally of its length so that its ends are cantilevered, pouring a hardenable and wearable deck material over a deck supporting surface extending the length of the girder-box and allowing the cantilevered load of the box-girder and the superimposed deck material to deform the beam into a bow shape with the center support of the beam located at the center of the bow, and then curing the material which forms the deck while the beam is deformed in a bow shape to lock in the tension and compression stresses which are created within the beam by its deformation.

1 Claim, 5 Drawing Sheets

PREFABRICATED BRIDGE WITH PRESTRESSED ELEMENTS

BACKGROUND OF THE INVENTION

The instant invention relates to prestressed steel bridge elements which are prefabricated and erected in modular form.

In addition to the normal rate of bridge building, there is a recent accelerated demand to refurbish the nation's highway infrastructure, including replacement of many existing crossings that have fallen into disrepair. There is also a frequent need for quick erection of temporary emergency crossings. Modern bridges are commonly built using one of two methods. The first uses a truss or girder system, typically of structural steel or prestressed concrete beams which are covered by a poured concrete top deck. Another method utilizes poured in place concrete.

Prestressed concrete is well known in building structures of all kinds and typically comprises reinforced concrete which is placed in compression prior to its integration into a structural system, that is, before it starts interacting with the other members of the structure and before loads are introduced. Concrete is frequently prestressed by one of two methods. The pretensioned method involves placing a concrete beam or other member in compression by enclosing pretensioned steel wires within the poured concrete within a mold. A post-tension method of prestressing places the concrete in compression by tensioning the interior cables after the section is cast. Prestressing reduces the amount of concrete required for a given beam or structural member, increases the load-carrying ability of the concrete and reduces load-induced cracking.

More recently, steel structural elements have also been prestressed by the use of cables positioned within the structural profile so as to induce reverse stresses to those which will be occasioned under the normal loads anticipated in the structure. This procedure, however, requires expensive prestressing of the cables and the use of significant attachment points to the steel structure.

Accordingly, it is the primary object of the present invention to provide a modular type prestressed steel bridge beam which can be prefabricated without the use of structural trusses, removable forms or stressing cables.

It is a further object of the instant invention to provide a composite steel-concrete bridge beam which utilizes the weight of a concrete deck for prestressing the steel of which the beam element is constructed without the use of post-tensioned cables or wires.

It is an additional object of the invention to provide a bridge plank or beam which can be easily put in place without the use of cumbersome cranes.

A still further object of the invention is to provide a transport vehicle apparatus for unloading the prefabricated beam of the present invention directly onto bridge abutments.

Other and still further objects, features and advantages of the invention will become apparent from a reading of the following detailed description of a preferred form of the invention taken in connection with the accompanying drawings.

SUMMARY OF THE INVENTION

The instant invention includes a novel prefabricated steel-concrete bridge beam or girder and the method of fabricating the same. Each beam or plank comprises a braced three sided elongated steel plate welded box having a flat bottom and two upstanding sides with a fourth side constructed of steel mesh reinforced concrete poured onto a corrugated top deck supported by the upstanding sides of the box girder. Prestressing of the steel box beam is achieved by pouring the concrete top deck while the beam is supported at two spaced apart points equidistant from and close to the longitudinal center of the beam so that the ends of the beam are cantilevered and are without separate support. In this configuration the weight of the concrete top deck deforms the beam downwardly at its unsupported ends, creating tension in the topmost portion of the steel box and compression in the lower portions of the box, which stresses are locked in as the concrete cures. The subsequent placement of the beam on supports at each of its longitudinal ends reverses the locked in tension and compression stresses so that the dead load stresses within the beam become substantially zero.

The prefabricated beam is transported to the bridge site and positioned with the aid of a special transport vehicle with a boom which is extended beyond the bed of the truck and then supported at its distant end prior to acting as an overhead rail on which to carry the prefabricated beam from the bed of the transport vehicle to a position directly over the intended bridge supports. The number of beams used for a bridge varies with the desired width of the finished structure.

DETAILED DESCRIPTION

Figure 1:
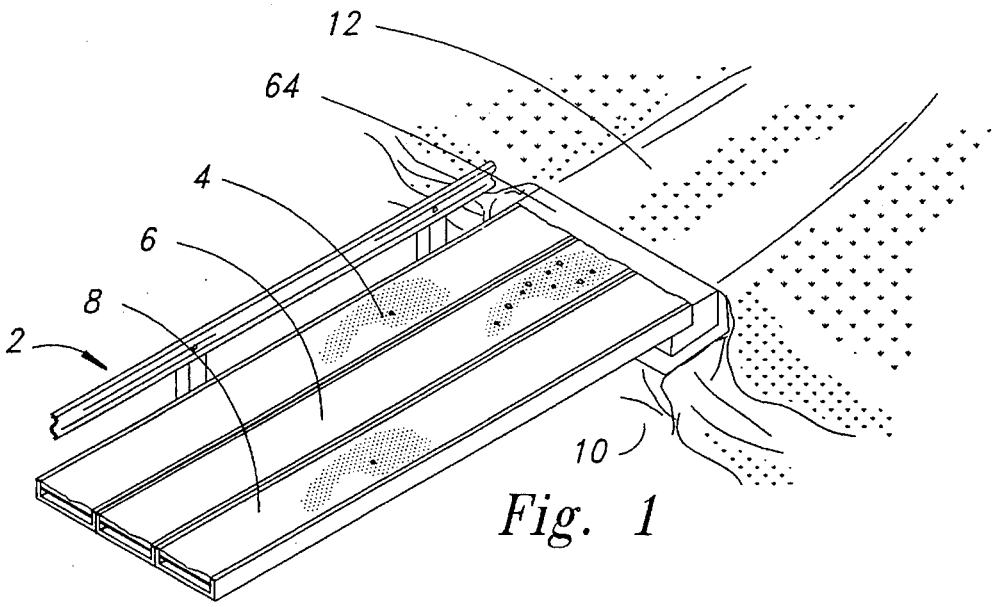
FIG. 1 is a perspective view of a bridge built with the use of three beams built according to the instant invention.
Figure 2:
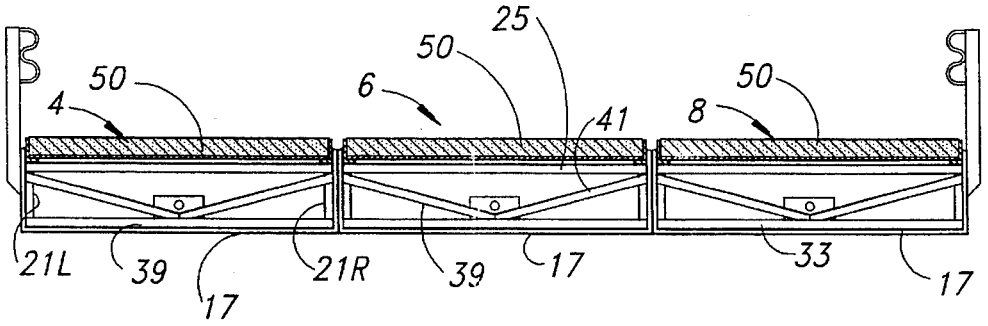
FIG. 2 is a diagrammatic lateral cross sectional view of the bridge of FIG. 1.

FIG. 1 is an overview of a bridge 2 constructed from the side by side combination of three prefabricated beams 4, 6 and 8 built in accordance with the instant invention. The bridge is a continuation of roadway 12, spanning a depression area shown generally at 10.

Figure 3:
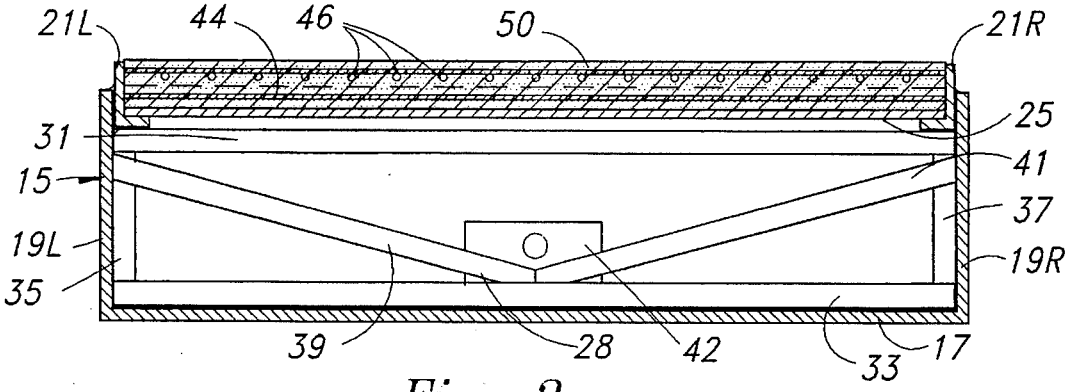
FIG. 3 is a detailed lateral cross-sectional view of a typical bridge beam of the present invention.

A typical one of the beams 4, 6 or 8 is shown in FIG. 3, formed as a box-girder 15 with a bottom 17 of plate steel and upstanding steel side plates 19L and 19R attached, as by welding, to the bottom plate 17 along its longitudinal edges. The structural box-girder is preferably formed of steel plate or other materials with strength in sheer and tension, such as a fiberglass composite. Attached, as by welding, to the inside surface of the upper portion of each side plate are angles 21L and 21R, the lower and laterally extending portions of which support a corrugated deck floor 25.

Figure 4:
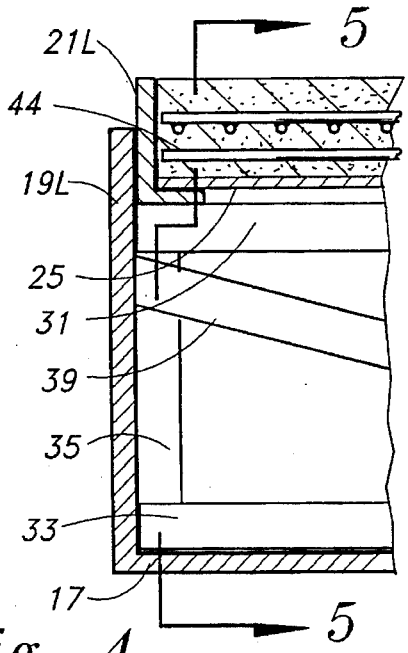
FIG. 4 is an enlarged fragmentary lateral cross section of one side of a typical bridge beam of the present invention.
Figure 5:
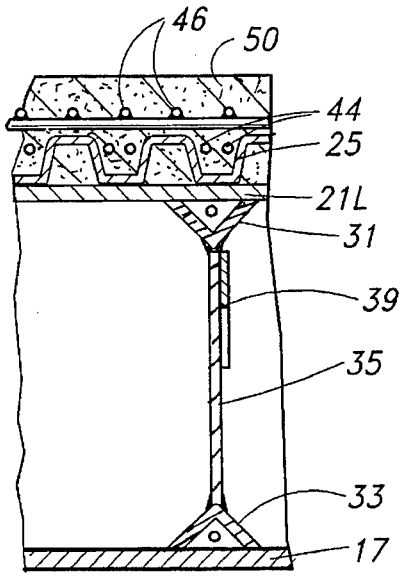
FIG. 5 is a fragmentary cross sectional view taken along lines 4—4 of FIG. 3.
Figure 6:
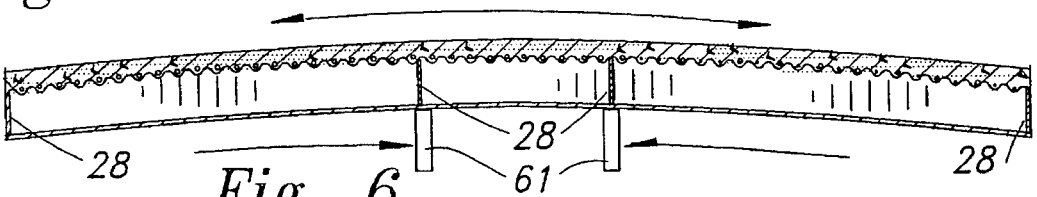
FIG. 6 is a diagrammatic longitudinal cross-sectional view of the bridge beam during prestressing.

At points along the length of the beam, as seen in FIG. 6, there are positioned bracing diaphragms 28. Referring to FIGS. 3–5, each diaphragm 28 is seen to comprise a rigid rectangle of stiffening members which include upper and lower horizontal lateral angles 31 and 33 and vertical side stiffeners 35 and 37. Diagonal braces 39 and 41 interconnect the top ends of the vertical side stiffeners with a common connecting plate 42 which is secured to the bottom lateral angle 33. The upper lateral angles 31 are abutted and attached to the undersurface of the lateral extensions of the deck supporting angles 21L and 21R while the lower lateral stiffening angles 33 are welded to the inside surface of the bottom girder-box plate 17. The diaphragms provide the rigidity required for the elongated girder-box beam. The diaphragms 28 can vary in number depending on the design specifications of the beam. In a typical beam 80 feet in length, 3 feet in depth and 8 feet wide four diaphragms may be used with one being placed at each of the ends of the girder-box and two placed near the center, three to six feet apart.

The deck of the bridge beam is formed of concrete poured onto the corrugated deck floor 25 and strengthened by a series of parallel steel reinforcing bars 44 disposed in the depressions of the corrugated floor together with a grid or mesh 46 formed of concrete, reinforcing steel and disposed above the corrugations of the floor 25 and below the surface of the poured concrete 50 in a manner well known. The term "concrete" means any pourable substance which hardens or cures into a wearable surface of structural integrity.

The novel method of prestressing the steel bridge beam 15 begins with the placement of the beam on a pair of supports 61 prior to the pouring of the concrete deck. The pouring supports 61 are positioned each side of the longitudinal center of the beam in such a fashion as to adequately support and balance the beam while at the same time allowing the ends of the beam to be cantilevered. Once positioned, the concrete is poured onto the corrugated floor 25 and the reinforcing steels 44 and 46. Added to the weight of the girder-box itself, the load of the concrete causes increased downward deflection of the ends of the beam, creating additional tension in the upper portions of the side members 19L and 19R and in the angles 21L and 21R, and creating additional compression forces in the lower portions of the side members and in the bottom plate 17. Depending on the design parameters of the bridge section, additional tension and compression forces can be created by adding additional weight to the ends of the structure prior to the curing of the concrete. As the concrete deck 50 cures the tension and compression stresses are locked in, creating a prestressing of the steel beam.

Figure 7:
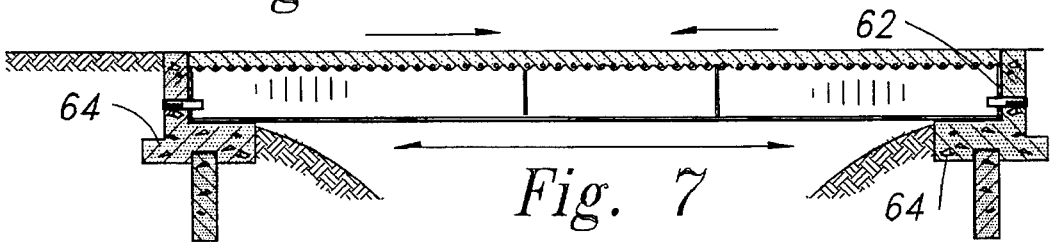
FIG. 7 is a diagrammatic longitudinal cross-sectional view of the bridge beam as it would be installed on the supporting structure in a bridge configuration.

Referring now to FIG. 7, the beam is shown in place at a bridge site where the ends of the beam are supported by generally "L" shaped abutments 64. With its ends supported, the weight of the beam causes the original upwardly bowed shape of the beam to be modified into a substantially straight configuration, reversing the locked in tension and compression stresses. Through the use of well known design techniques in sizing and specifying the materials of the bridge beam, the locked in stresses are reversed to the point where the dead loads represented by the bridge components become substantially zero. By thus minimizing the dead loads, the bridge components can be reduced in size and cost to that necessary to sustain only the live loads on the bridge represented by the vehicles which it must carry.

Figure 8:
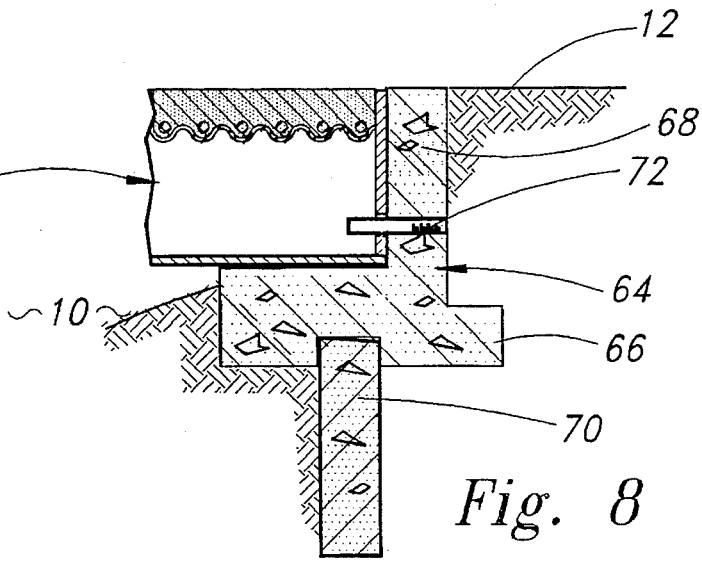
FIG. 8 is an enlarged fragmentary cross sectional view of one end of the bridge beam and its supporting abutment.

The abutments at the two ends of the bridge may also prefabricated, generally from concrete. FIG. 8 shows the anchor structure in detail. Each abutment 64 is essentially L-shaped with a base 66 and an upstanding leg 68. A piling 70 secures the anchor firmly into the ground. One or more pipe sections or sleeves 72 of approximately two inches in diameter are threaded into the leg 68 of the abutment and act to interconnect the bridge beam with the anchor leg 68. The bridge beam element into which the sleeve 72 is inserted is slidable on the sleeve so as to accommodate thermal expansion and contraction of the length of the steel beam. The sleeve connections however restrict lateral or vertical movement of the bridge beam on the abutment.

The prefabricated beam of the present invention lends itself not only to inexpensive and effective prestressing but also to ease of installation. As a complement to the beam just described, FIGS. 9 through 12 illustrate a transport vehicle which not only carries the prefabricated beam to its destination site but places it in the abutments 64 which have been described, without the use of cranes or similar independent lifting devices. While prior art vehicles have used overhead tracks and trolleys to assist in the loading and unloading of the cargo, the device of the present invention goes beyond the prior art to encompass a whole system for placing large beams, such as the one just described, in place.

Two inverted U-frames 71 are installed at each end of a flatbed truck trailer 73 in a position to straddle the load. At their apexes the frames 71 support a telescoping boom 75 which comprises inner and outer rectangular tubes 77 and 79, arranged for telescoping movement with respect to one another. The inner tube 77 is supported for sliding movement inside the outer tube 79 by a pair of upper and a pair of lower wheels 81 and 83. Attached to the end of the inner tube 77 which extends over the rear end of the truck bed is an end frame assembly 84, which preferably comprises a pair of hydraulically adjustable pistons as legs 86. A plurality of trolleys 85, well known in the industry, are movably supported by the outside tube. Each of the trolleys 85 carry a pair of depending vertical members 88 which in turn carry a laterally extending beam 87 on which is supported one or more secondary trolleys 91 which are adapted to hook onto a point on the beam 15 which is being carried on the bed of the truck.

Figure 9:
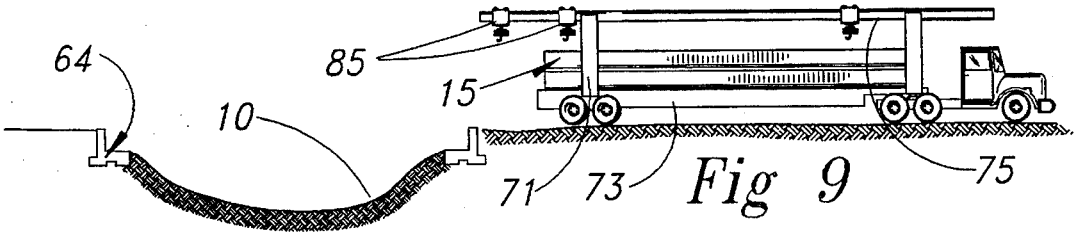
FIG. 9 is a side view of the transport vehicle as it approaches the draw or depression to be bridged.
Figure 10:
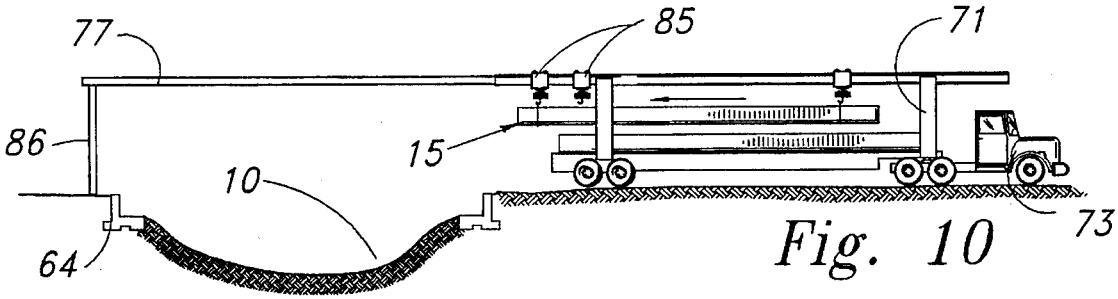
FIG. 10 is a side view of the transport vehicle with the carriage boom extended over the depression to be bridged and showing the bridge beam in the first stage of being unloaded from the vehicle.
Figure 11:
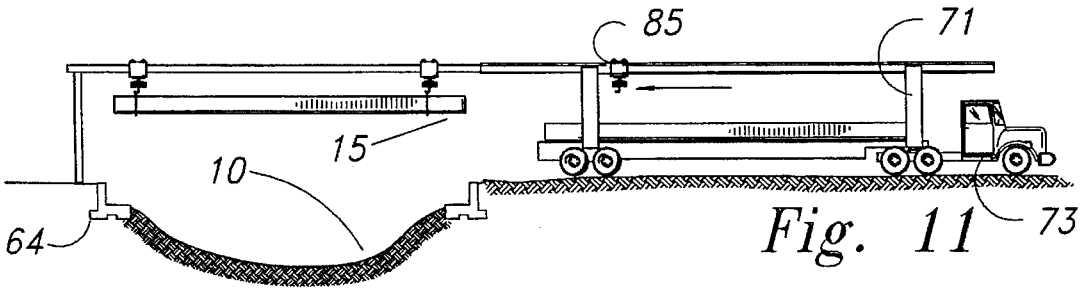
FIG. 11 is a side view of the transport vehicle with the carriage boom extended over the depression to be bridged and showing the bridge beam positioned over the depression prior to lowing the beam onto its supporting structures.
Figure 12:
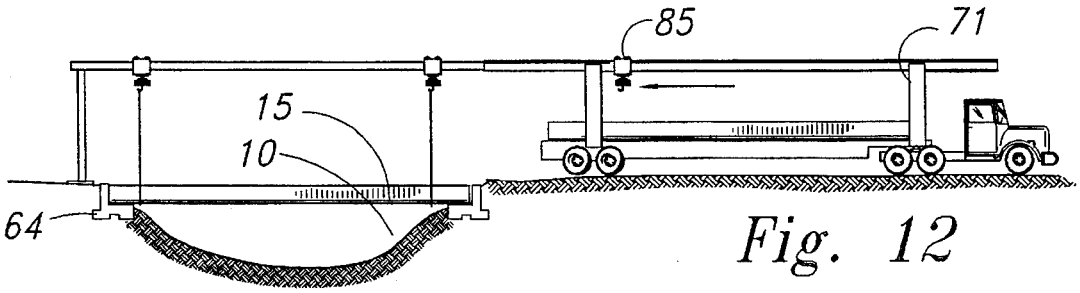
FIG. 12 is a side view of the transport vehicle with the carriage boom extended over the depression to be bridged and showing the bridge beam 1owed onto its supporting structures.
Figure 13:
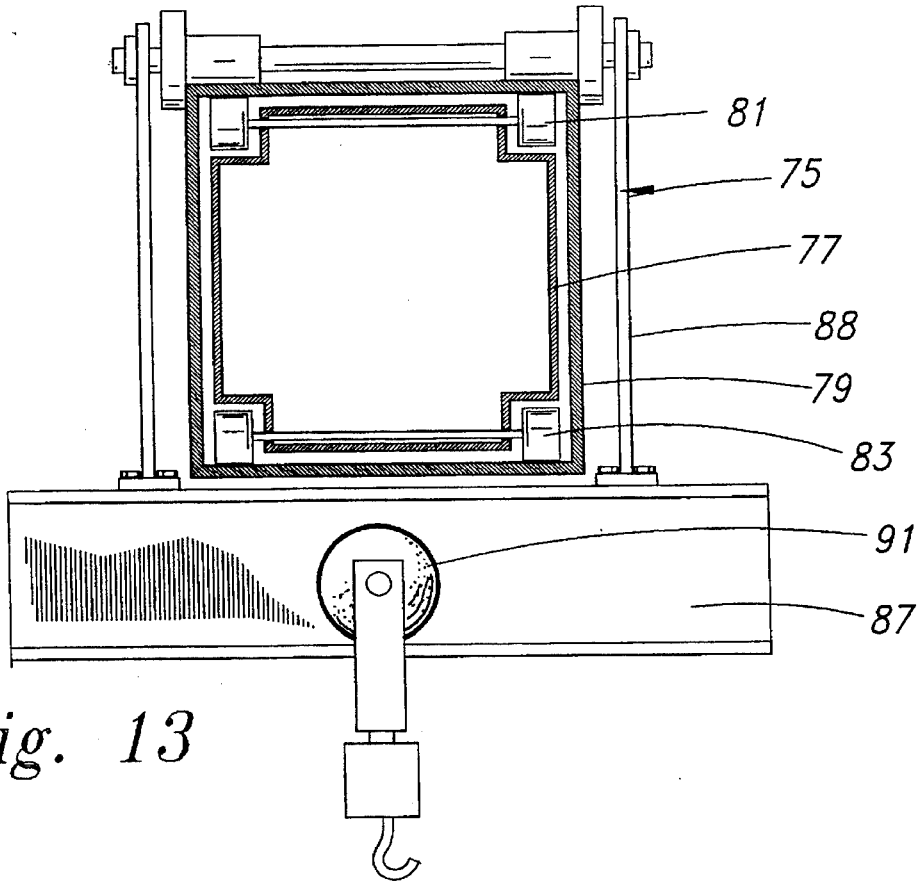
FIG. 13 is an enlarged lateral cross sectional view of the overhead boom of the transport vehicle.

At the site of the bridge construction, as shown in FIG. 9, the truck is positioned so that the rear end of the flat bed 73 is next or very close to one of the abutments 64 on which the beam will be laid and the longitudinal axis of the flat bed is aligned with the position which the beam will assume in the bridge. Having correctly positioned the flatbed trailer, the inner boom tube 77 is extended over the depression 10 so that the end frame assembly 84 comes to rest just beyond the bridge beam abutment 64 on the opposite bank, as illustrated in FIG. 10. The end frame legs 86 are then anchored into a ground contacting position to support the end of the extended inner boom tube 77 and level it. Once the outer end of the inner boom is adequately anchored in place, the trolleys 85, with their accompany hoists, carry the bridge beam 15 along the length of the outer tube 79 and onto the extended inner boom tube 77, transporting the bridge beam out over the bridge abutments 64, as seen in FIG. 11. When positioned over the abutments the trolley hoists are activated in a well known manner to lower the beam into place on the abutments 64. After placement of the bridge beam the extended boom 77 is withdrawn into the outer boom tube 79.

Figure 15:
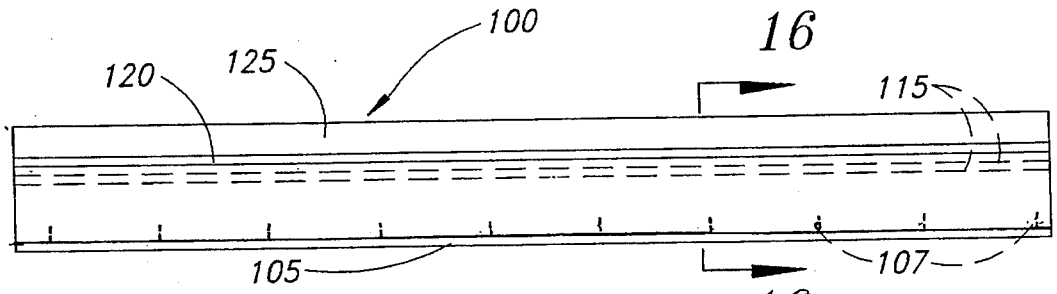
FIG. 15 is a side view of a alternate form of the bridge beam of the present invention.
Figure 16:
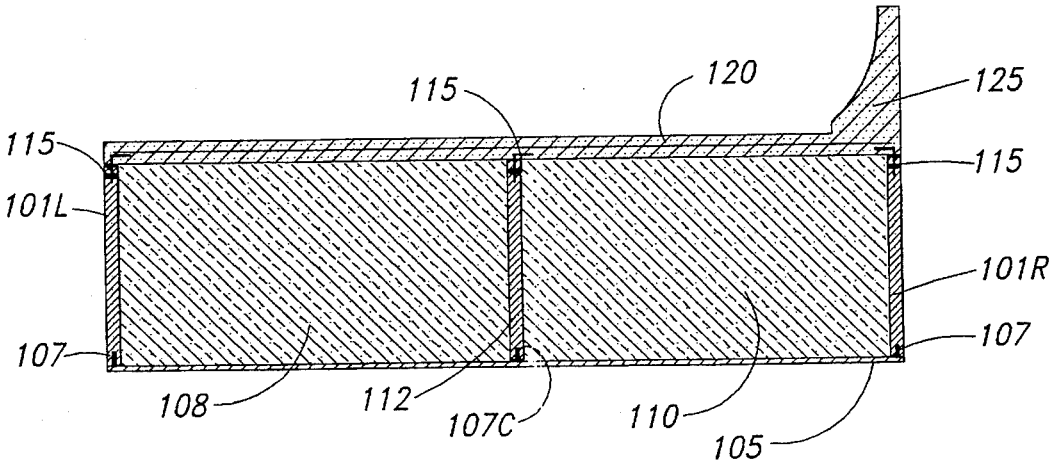
FIG. 16 is an enlarged cross sectional view taken along lines 16—16 of FIG. 15.

A second embodiment of the prefabricated and prestressed bridge beam 100 of the present invention is illustrated in FIGS. 15 and 16. In this construction the sides 101L and 101R of the box girder are made of concrete instead of steel, as in the preferred embodiment. A steel bottom plate 105 is provided with a plurality of shear connectors 107 along the edges and down the longitudinal center line of the bottom plate. Onto these studs is poured the side walls 101L and 101R, using a pair of styrofoam blocks 108 and 110 as the inside forming panel for the side walls. The styrofoam blocks are spaced apart in the center of the bridge beam, allowing a space for the pouring of a middle concrete web member 112 which is secured to the bottom plate by the center row of studs 107C. Prior to pouring of the web 112 and the side walls, rebar reinforcing steel 115 is placed along the top portion of the spaces to be filled with the concrete. Concrete is poured into the forms for the side walls and the center web with the bottom plate 105 in a level position.

Following the curing of the concrete side walls and center web, the beam 100 is placed on supports similar to the supports 61 shown in FIG. 6 for the preferred embodiment. On these supports the cantilevered ends of the beam deflect downwardly as the concrete deck 120 is poured over the styrofoam blocks 108 and 110, similarly to the prestressing process of the first described embodiment. In the deflected form, the reinforcing steel rods 115 are stressed in tension due to the deflection of the cantilever, while the bottom plate 105 is put into compression. As the concrete deck cures, these stresses are locked into the beam in the same fashion as in the first embodiment and are substantially equalized when the beam is placed into position on a bridge where the support comes from abutments at the extreme ends of the beam.

Figure 14:
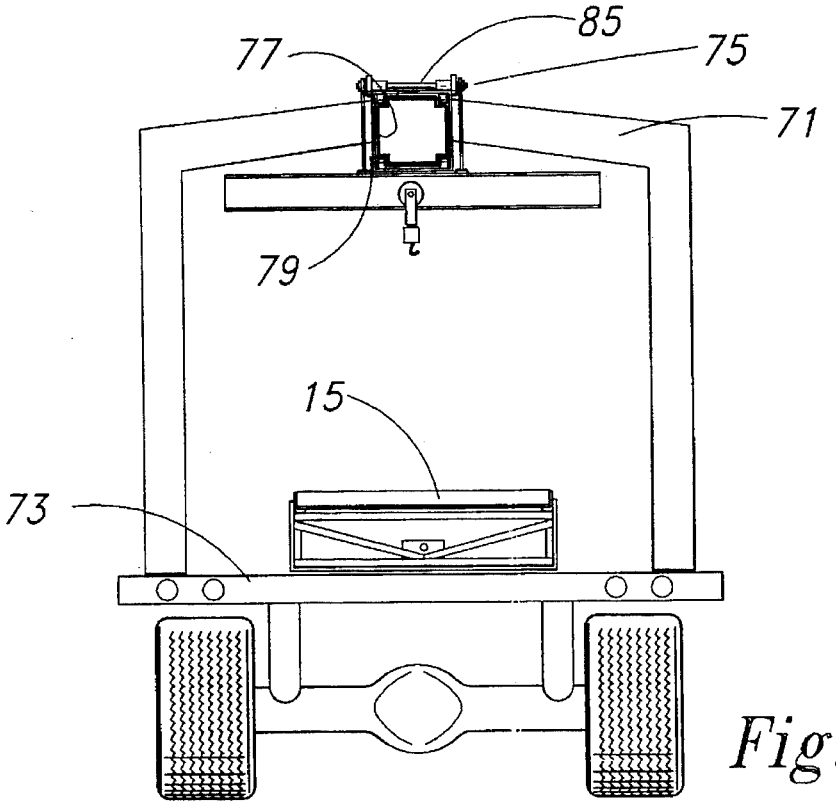
FIG. 14 is an enlarged lateral cross sectional view of the bed of the transport vehicle.

As an option, an integral guard rail 125 may be formed with the concrete deck 120 when it is poured. The guard rail shown in FIG. 14 may also be made part of the deck structure in the beam of the preferred embodiment.

I claim:

1. A prefabricated bridge beam with prestressed elements comprising:

a box-girder including a bottom plate prestressed in compression and a pair of upstanding side members each having upper portions prestressed in tension, where the side members are poured concrete having longitudinal reinforcing rods proximate their upper extremity;

a rigid deck supporting surface carried by the box-girder; and a poured in place and cured concrete bridge deck carried by the supporting surface, wherein said cured concrete deck secures in place the said tension and compression stresses.

* * * * *